US007913523B2

(12) United States Patent
Lyu et al.

(10) Patent No.: US 7,913,523 B2
(45) Date of Patent: Mar. 29, 2011

(54) HEATER COUPLING APPARATUS OF WASHING MACHINE

(75) Inventors: Jae Cheol Lyu, Changwon-si (KR); Dong Yoon Kim, Changwon-si (KR); Sang Gyu Lim, Daegoo-si (KR); Jong Sun Yoon, Jinjoo-si (KR); Chang Woo Son, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 1294 days.

(21) Appl. No.: 11/445,454

(22) Filed: Jun. 2, 2006

(65) Prior Publication Data

US 2007/0017082 A1 Jan. 25, 2007

(30) Foreign Application Priority Data

Jun. 3, 2005 (KR) ..... 10-2005-0047894

(51) Int. Cl.
*D06F 39/04* (2006.01)
*B23P 11/00* (2006.01)

(52) U.S. Cl. ..... 68/15; 29/434

(58) Field of Classification Search ..... 29/434, 29/428, 505, 525, 525.01; 68/15, 12.12, 68/12.15, 12.22
See application file for complete search history.

(56) References Cited

U.S. PATENT DOCUMENTS 5,361,421 A * 11/1994 Blankenship ..... 4/111.5
2004/0083770 A1* 5/2004 Lyu ..... 68/15
* cited by examiner

*Primary Examiner* — John C Hong
(74) *Attorney, Agent, or Firm* — Ked & Associates LLP

(57) ABSTRACT

Provided is a heater coupling apparatus of a washing machine and a coupling method for the heater coupling apparatus. The heater coupling apparatus includes a tub, a heater coupling portion, a heater, and a bracket. The heater coupling portion is formed on the tub. The heater is coupled to the heater coupling portion. The bracket forms a closed loop portion in a shape of a closed loop, to dispose the heater within the closed loop portion.

12 Claims, 7 Drawing Sheets

【 Figure 1】
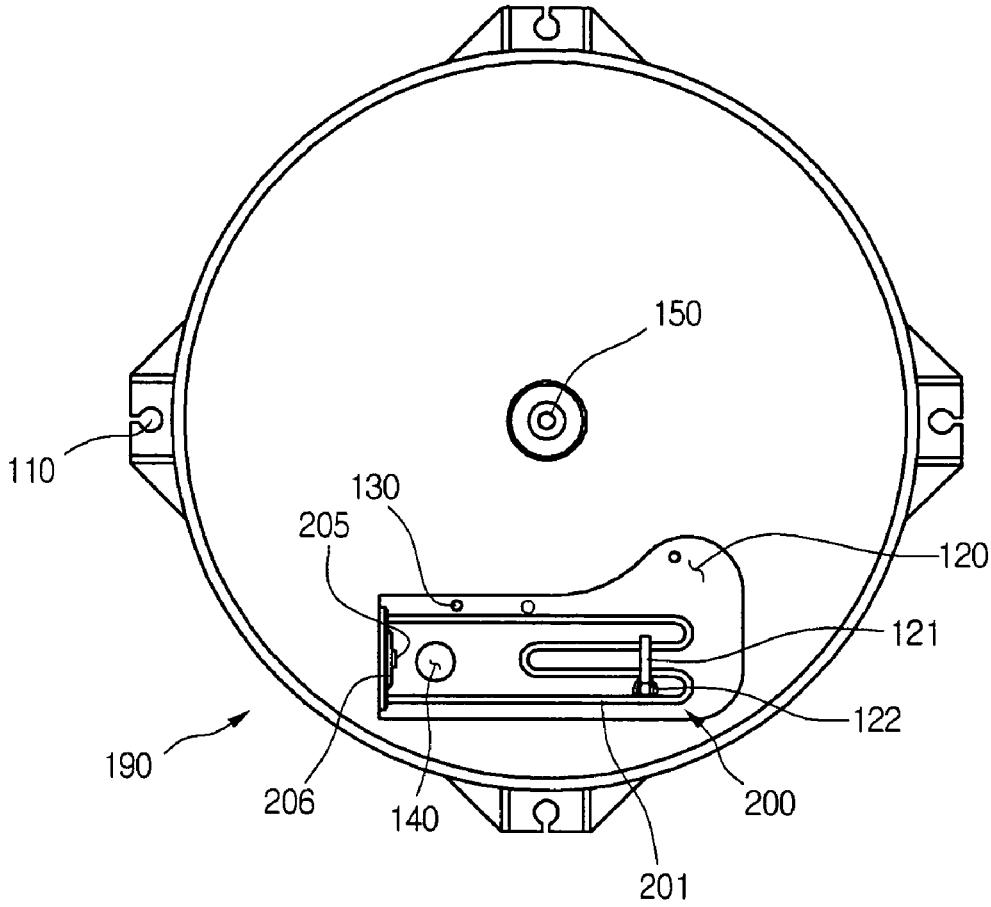

[Figure. 2]
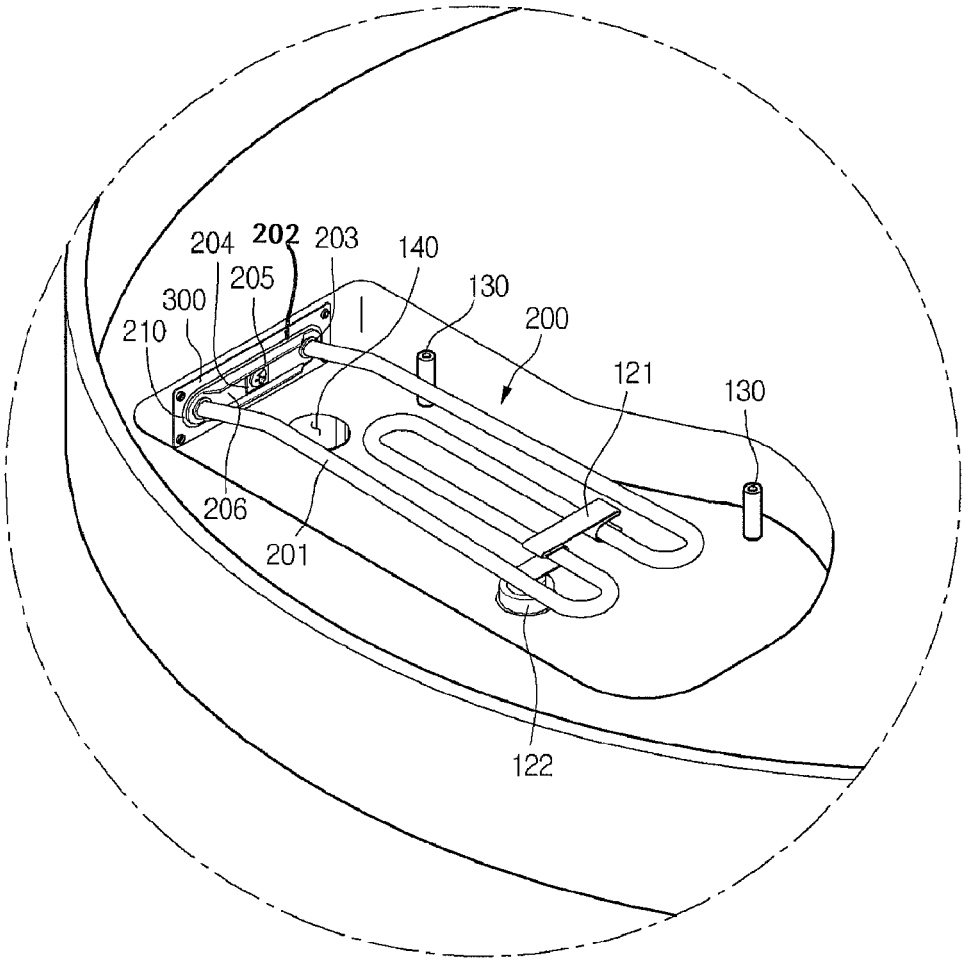

【 Figure 3】
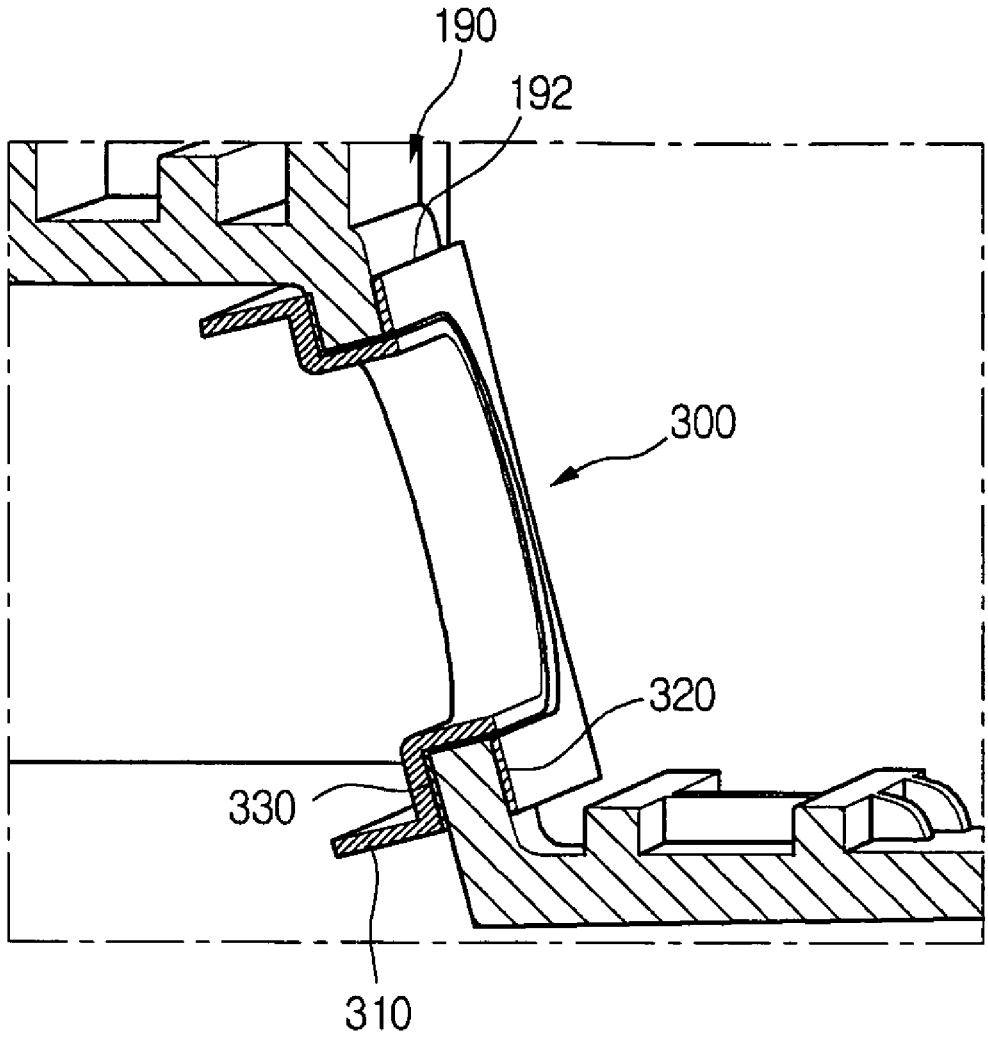

【 Figure 4】
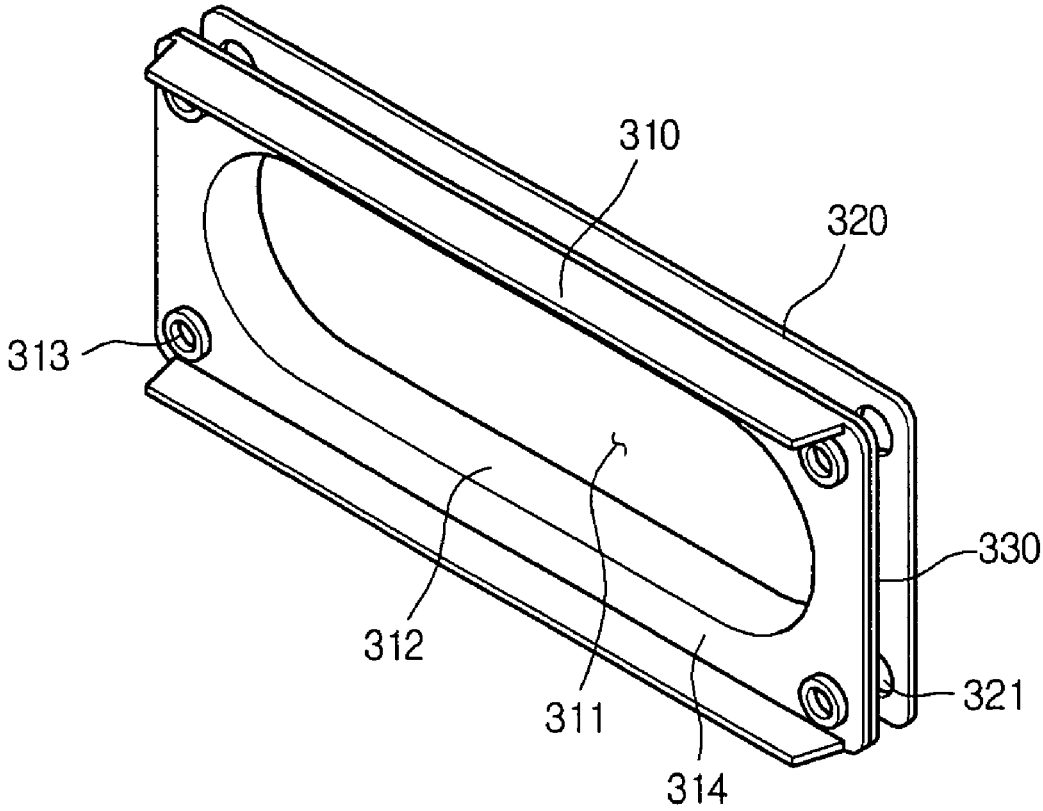

【 Figure 5】
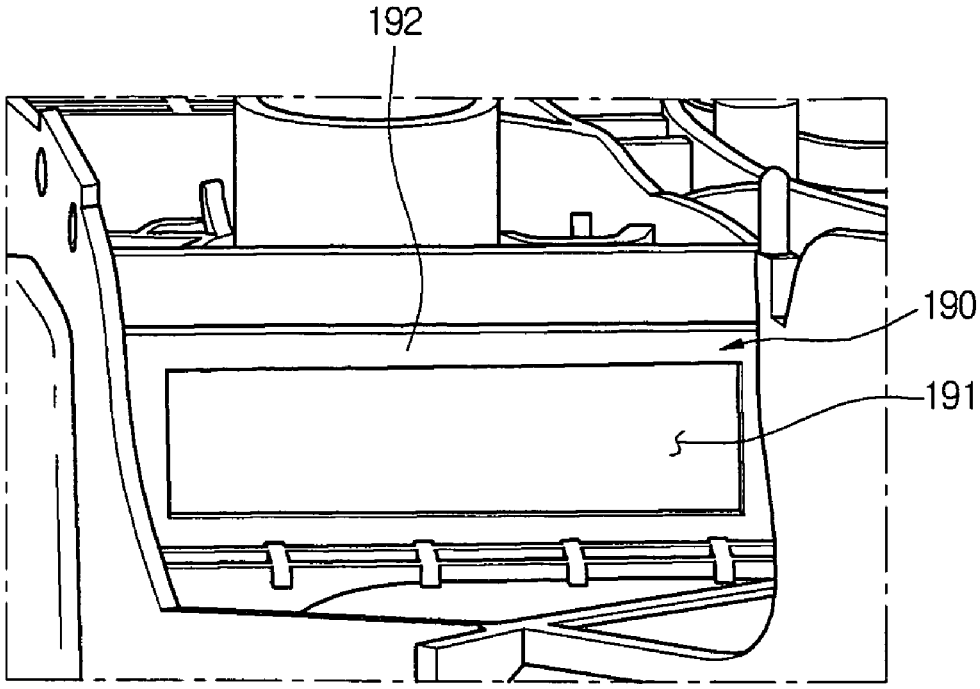

【 Figure 6】
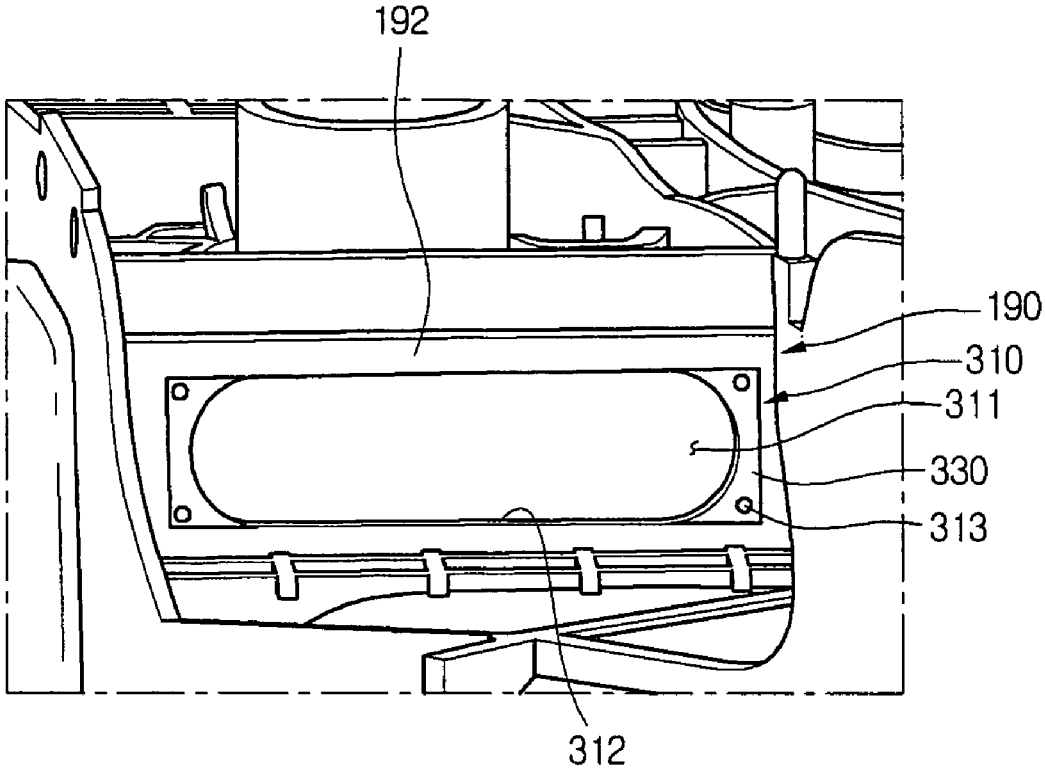

【Figure 7】
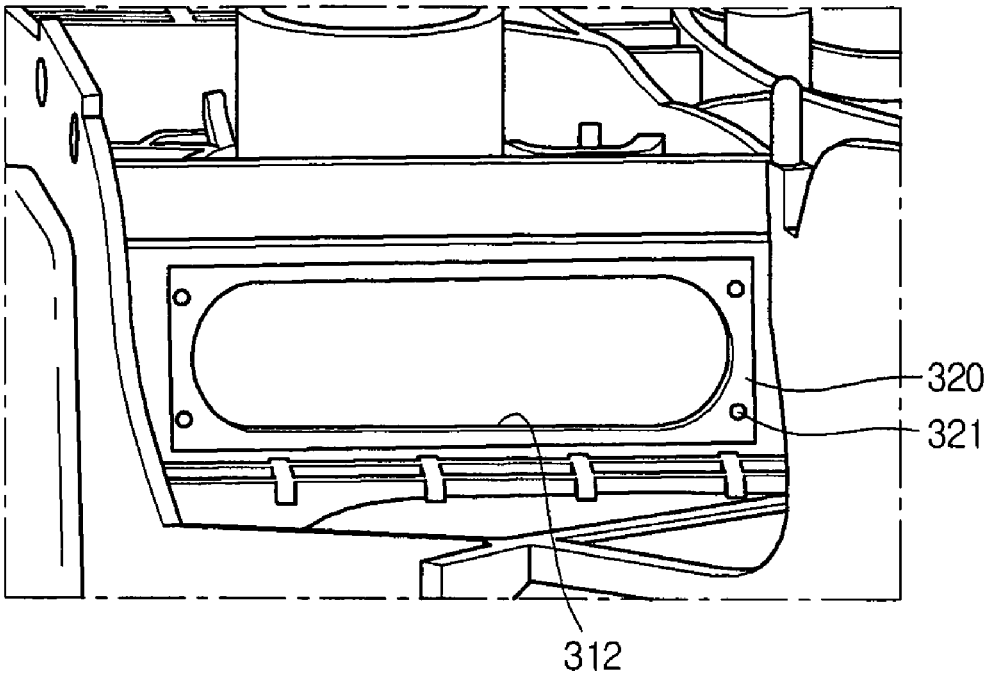

HEATER COUPLING APPARATUS OF WASHING MACHINE

BACKGROUND OF THE INVENTION

1. Field of the Invention

The present invention relates to a washing machine, and more particularly, to an apparatus and a method for coupling a heater of a washing machine.

2. Description of the Related Art

A washing machine generally has a cabinet forming an outer shape thereof and a tub installed within the cabinet. The tub, which stores wash liquid within, is supported by a damper connected at the top portion of the cabinet. A wash compartment is rotatably installed within the tub. Specifically, a plurality of through-holes are formed in the bottom and side surfaces of the wash compartment, so that wash liquid stored in the tub can freely flow between the wash compartment and the tub to remove impurities from laundry.

A heater is installed on the floor of the tub for heating wash liquid to produce hot wash liquid. Accordingly, when the heater operates during the winter when cold water enters the tub, the water is heated to a suitable washing temperature, so that a separate water heater does not need to be installed at a water faucet.

However, compared to the heater and its bolts, a conventional tub is structurally weak, due to being injection molded plastic. Therefore, when stress is continuously applied to the inside of the tub, the region of the tub to which the heater is coupled is prone to cracking. Cracking results in wash liquid leaking through the cracks and a substantial decrease in product reliability of the washing machine.

SUMMARY OF THE INVENTION

Accordingly, the present invention is directed to a heater combining apparatus and method of a washing machine that substantially obviates one or more problems due to limitations and disadvantages of the related art.

An object of the present invention is to provide an improved apparatus and method for combining a heater to a tub of a washing machine that prevents cracking of the tub.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heater coupling apparatus of a washing machine, including: a tub; a heater coupling portion formed on the tub; a heater coupled to the heater coupling portion; and a bracket forming a closed loop portion in a shape of a closed loop, for disposing the heater within the closed loop portion.

In another aspect of the present invention, there is provided a heater coupling apparatus of a washing machine, including: a tub; a heater coupling portion formed on the tub; a heater coupled to the heater coupling portion; and a bracket interposed between the heater coupling portion and the heater, for absorbing pressure applied to the heater coupling portion by a coupling of the heater.

In yet another aspect of the present invention, there is provided a coupling method for a heater coupling apparatus of a washing machine, including: preparing a tub, a heater coupling portion formed on the tub, a heater, and a bracket forming a closed loop portion in a shape of a closed loop and divided into a plurality of parts; installing a first bracket portion from the plurality of parts on the tub; coupling a bracket portion other than the first bracket portion from the plurality of parts to the first bracket portion; and inserting the heater in the closed loop portion.

The heater combining apparatus and method of a washing machine according to the present invention forms a closed loop portion that can absorb pressure applied on the coupled regions by the coupling of the heater. Accordingly, the closed loop portion blocks the transfer of pressure, so stress on the tub from opposing the pressure can be reduced, preventing cracking of the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a plan view showing a heater installed on the bottom surface of a tub according to the present invention;

FIG. 2 is a rear perspective view of the tub with the installed heater in FIG. 1;

FIG. 3 is a vertical sectional view showing an apparatus for combining the heater of a tub according to the present invention;

FIG. 4 is a perspective view of a first and a second bracket according to the present invention;

FIGS. 5 through 7 are diagrams-showing a combining method of a heater according to the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a plan view showing a heater installed on the bottom surface of a tub according to the present invention, and FIG. 2 is a rear perspective view of the tub with the installed heater in FIG. 1.

Referring to FIGS. 1 and 2, the washing machine according to the present invention has a cylindrical tub 190 with a predetermined diameter and height.

Specifically, the tub 190 has damper insert holes 110 formed on the sides thereof for coupling ends of dampers thereto. A through-hole is formed at the center of the tub 190 for a washing shaft 150 to insert through. A heater receptacle 120 recessed a predetermined depth is formed at a side on the bottom surface of the tub 190 for mounting a heater 200.

A drain hole 140 for draining wash liquid is formed in the floor of the heater receptacle 120, and at least one heater cover fastening boss 130 is formed to protrude a predetermined distance from the perimeter of the heater receptacle 120.

Also, a thermostat 122 is mounted on a side of the heater receptacle 120, for determining whether the heater 200 has been heated, and a clamp 121 for fixing the heater is disposed above the thermostat 122.

A heater insert hole 191 is formed at the bottom surface of the tub 190 for inserting the heater 200. In detail, the insert hole 191 is formed to protrude a predetermined depth into the bottom surface of the tub 190, in order to prevent moisture or wash liquid from entering the terminals of the heater 200.

Here, the heater insert hole 191, as a portion for coupling the heater 200 to the tub 190, may be defined as a heater coupling portion. This heater coupling portion may adopt various embodiments other than the heater insert hole 191.

The heater 200 received in the heater receptacle 120 includes a heater pipe 201 formed with a predetermined diameter and length and bent a plurality of times at a predetermined location, and a power connector 203 formed at each end of the heater pipe 201 to electrically connect to the heater pipe 201 for supplying power thereto.

The heater 200 also includes a sealing member 210 inserted through the power connector 203. Before the sealing member 210 is inserted, a pressing plate 206 for pressing the sealing member is first inserted. A sealing case 202, recessed a predetermined depth to accommodate the sealing member 210, is inserted at the rear of the sealing member 210, for preventing leakage of wash liquid from the heater insert hole 191. Here, the sealing case 202 is tightly pressed against the outer wall of the tub 190 through a tightening member (to be described later).

The pressing plate 206 and the sealing case 202 are firmly tightened with an assembly bolt 205 passing through the center of the pressing plate 206 and an assembly nut 204. In further detail, the sealing member receives a high level of pressure between the pressing plate 206 and the sealing case 202 from the assembly nut 204 that tightens along the threaded outer portion of the assembly bolt 205. Here, the sealing member uses a material with a predetermined elasticity and flexibility, which may be rubber.

In further detail, the sealing member may have the same shape as the heater insert hole 191 or be slightly smaller, so that it can easily insert into the heater insert hole 191. However, the thickness of the sealing member is formed to be thicker than the tub 190.

Here, when the sealing member receives pressure from the assembly bolt 205 and the assembly nut 204, the upper portion of the sealing member flattens within the inner perimeter of the tub 190, as shown in the diagrams. Thus, the surface area of the sealing member becomes wider than that of the heater insert hole 191. Accordingly, the sealing member widens with pressure to completely seal the heater insert hole 191, to prevent wash liquid leaking into the heater insert hole 191.

The heater pipe 201 of the heater 200, as described above, has a predetermined diameter and length, and is made of a conductive material that is bent a plurality of times. Here, the length of the heater pipe 201 and the number of times it is bent may depend on the required length, number of bends, etc. of the heater pipe 201.

In the present invention, by installing a first bracket portion 310 and a second bracket portion 320 as a pair, cracking may be prevented when the heater 200 is combined with the tub 190. This will be described in more detail below.

FIG. 3 is a vertical sectional view showing an apparatus for combining the heater of a tub according to the present invention.

Referring to FIG. 3, the combining structure of a heater to a tub according to the present invention includes a heater 200 for heating wash liquid inside a tub, a tub 190 for combining the heater 200 to, and a first and a second bracket portion 310 and 320 for preventing cracking of the tub 190. Here, the first and second bracket portions 310 and 320 form a bracket 300.

The heater 200 includes a pressing plate 206, a sealing case 202 contacting the wash liquid and formed at the end of a heater pipe 201 that heats the wash liquid, and a sealing member 210 provided between the heater 200 and the tub 190 for sealing the gap therebetween. The heater 200 may be cohered with the pressing plate 206, the sealing case 202, and the sealing member 210 through a separate assembly bolt 205 and nut 204.

The tub 190 includes a bracket insert hole 191 formed for inserting a predetermined part of the first bracket portion 310, and a bracket insert hole forming portion 192 for forming the bracket insert hole 191.

The first and second bracket portions 310 and 320 contact the sealing member when the heater 200 is coupled to the tub 190. In other words, the first and the second bracket portions 310 and 320 prevent direct contact between the sealing member and the tub 190, or more specifically, between the sealing member and the bracket insert hole forming portion 192. When thus structured, and the heater is coupled 200, the pressure applied to the inserted sealing member is transferred to the first and second bracket portions 310 and 320 it contacts. Thus, virtually none of the pressure from the sealing member is transferred to the tub 190, or more specifically, to the bracket insert hole forming portion 192. Therefore, stress in the tub 190 reacting to the pressure is reduced. Accordingly, due to the insertion of the sealing member, cracking of the tub 190 can be prevented.

According to this embodiment, a bracket sealing portion 330 for sealing the space between the first and second bracket portions 310 and 320 is installed between said first and second bracket portions 310 and 320. In this configuration, the space between the first and second bracket portion 310 and 320 is sealed. Thus, the sealing function of the bracket sealing portion 330, along with the sealing function of the sealing member sealing the space between the bracket 300 and the heater 200, can increase the reliability of the seal between the heater 200 and the tub 190.

FIG. 4 is a perspective view of a first and a second bracket according to the present invention.

Referring to FIG. 4, the first and second bracket portions 310 and 320 according to the present invention form the bracket 300 and are coupled to the tub 190 to prevent cracking of the tub 190.

Here, the bracket 300 is divided into a first and second bracket portion 310 and 320; however, this is only exemplary. That is, the bracket 300 may be divided into a plurality of bracket portions and may be formed by coupling the various bracket portions.

The first bracket portion 310 includes a heater insert hole 311 for inserting the heater 200, and a closed loop portion 312 forming the heater insert hole 311. A tub coupling portion 314 is formed to extend from the closed loop portion 312 on the first bracket portion 310 to form the periphery of the closed loop portion 312. The tub coupling portion 314 is a portion for coupling the bracket 300 and the tub 190.

The closed loop portion 312 autonomously forms a closed loop. Thus, the closed loop portion 312 can absorb pressure put on the heater coupling portion 191 when the heater 200 is inserted therein. Accordingly, the closed loop portion 312 blocks the transfer of pressure from the heater coupling portion 191, so that the cracking of the tub 190 is prevented.

The closed loop 312 is connected to the tub coupling portion 314. Also, the closed loop portion 312 forms a shape corresponding to the shape of the portion of the heater 200 that inserts into the closed loop portion 312. The closed loop portion 312 also passes through the heater coupling portion 191.

In the above structure, the first bracket portion 310 is coupled to the tub 190, after which the inner surface of the closed loop portion 312 contacts the sealing member and functions as a seal. Therefore, the sealing member and the tub 190 do not directly contact one another, and the pressure of the sealing member is not transferred, so that cracking of the tub 190 can be prevented.

A first coupling hole 313 is formed in the tub coupling portion 314 so that the second bracket portion 320 and the tub 190 may be coupled through a separate bolt or other coupling member. In order to increase the coupling reliability of the first coupling hole 313, each part of the first bracket portion 310 may be formed in plurality.

A second coupling hole 321 is formed in the second bracket portion 320 opposite the first coupling hole 313, for the coupling member fixed in the first coupling hole 313 to pass through.

As described above, the first bracket portion 310 forms a portion surrounding the closed loop portion 312, to allow the bracket sealing portion 330 that seals the space between the bracket 300 and the tub 190 to be further installed.

FIGS. 5 through 7 are diagrams showing a combining method of a heater according to the present invention.

Referring to FIGS. 5 through 7, the combining method of the heater 200 according to the present invention will now be described. Here, the description of each element shall be deemed replaced by the previous descriptions thereof, and repetitive descriptions shall thus be omitted.

First, as shown in FIG. 5, a tub 190 is made. The bracket insert hole 191 and the bracket insert hole forming portion 192 are formed in the tub 190.

Next, as shown in FIG. 6, the first bracket portion 310 is inserted in the bracket insert hole 191. The inserting of the first bracket portion 310 is performed from the inside to the outside of the tub 190. Then, the closed loop portion 312 protrudes out of the tub 190. Here, the bracket sealing portion 330 installed around the closed loop portion 312 contacts the tub 190.

Subsequently, as shown in FIG. 7, the second bracket portion 320 is coupled to the first bracket portion 310. This coupling may be performed by passing a bolt or other separate coupling member through the first and second coupling holes 313 and 321. When the above coupling is done, the first and second bracket portions 310 and 320 may be fixed to the tub 190. This coupling compresses and deforms the bracket sealing portion 330 disposed between the first and second bracket portions 310 and 320, so that the space between the first bracket portion 310, second bracket portion 320, and tub 190 is sealed.

Thereafter, the heater 200 is inserted in the heater insert hole 311, and the sealing member that is a component of the heater 200 is inserted in the heater insert hole 311 to contact the closed loop portion 312. In this condition, when the assembly bolt and nut 204 and 205 are tightened, the tightening compresses the sealing member and deforms it. The sealing member thus presses against the closed loop portion 312 that it contacts.

As described above, the pressure on the sealing member of the present invention is transferred to the first and second bracket portions 310 and 320, and is thus prevented from being transferred to the tub 190. In this way, stress that may be generated in the tub 190 in opposition to pressure is reduced, and cracking of the tub 190 can be prevented by the insertion of the sealing member.

The heater combining apparatus and method of a washing machine according to the present invention forms a closed loop portion and absorbs pressure applied to a heater coupling portion through the coupling of the heater. Therefore, the closed loop prevents transferring of the pressure to the tub, and reduces stress that may otherwise be generated in the tub to counter the pressure, so that cracking of the tub can be prevented.

Also, the heater combining apparatus and method according to the present invention further installs a bracket sealing portion to reliably seal the space between the bracket and the tub.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heater coupling apparatus of a washing machine, comprising:

a tub having a coupling portion;

a heater coupled to the coupling portion of the tub, the heater including a sealing member that prevents wash liquid from leaking into the coupling portion of the tub; and a plurality of brackets that couple the heater to the coupling portion of the tub, the plurality of brackets comprising:

a first bracket having a closed loop portion that defines a heater insertion opening that receives the heater therein;

a second bracket coupled to the first bracket; and a bracket seal that seals a space between the first and second brackets.

2. The heater coupling apparatus according to claim 1, wherein a gap between heater insertion opening defined by the closed loop portion of the first bracket and the heater is sealed.

3. The heater coupling apparatus according to claim 1, wherein the first bracket includes a tub coupling portion that couples the first bracket to the tub.

4. The heater coupling apparatus according to claim 3, wherein the tub coupling portion is formed around the closed loop portion of the first bracket.

5. The heater coupling apparatus according to claim 1, wherein the first bracket is coupled to an inner side of the tub, and the second bracket is coupled to an outer side of the tub.

6. The heater coupling apparatus according to claim 1, wherein the closed loop portion of the first bracket passes through the coupling portion of the tub.

7. A heater coupling apparatus of a washing machine, comprising:

a tub having a heater coupling portion;

a heater coupled to the coupling portion of the tub;

a first seal that seals an interior portion of the tub from the coupling portion of the tub so as to prevent wash liquid in the tub from leaking into the coupling portion; and a plurality of brackets interposed between the coupling portion of the tub and the heater, wherein the plurality of brackets absorb pressure applied to the coupling portion by a coupling of the heater thereto, the plurality of brackets including a first bracket having a closed loop portion that defines an opening in which the heater is received, wherein inner surfaces of the closed loop portion contact the first seal.

8. The heater coupling apparatus according to claim 7, wherein the plurality of brackets includes a second bracket coupled to the first bracket so as to prevent direct contact between the first seal and the tub.

9. The heater coupling apparatus according to claim 7, wherein the pressure applied on the coupling portion by the coupling of the heater is absorbed by the closed loop portion of the first bracket.

10. The heater coupling apparatus according to claim 7, further comprising a second seal that seals a space between the coupling portion of the tub and the plurality of brackets.

11. A heater coupling apparatus for a washing machine, the apparatus comprising:

a heater receiving opening formed in a tub of the washing machine and configured to receive a heater therein;

a first bracket positioned in the heater receiving opening, the first bracket having a side thereof positioned at an interior side of the tub;

a second bracket coupled to the first bracket, the second bracket having a side thereof positioned at an exterior side of the tub; and a first seal installed between the first bracket and the second bracket so as to fill a space formed between the first and second brackets and form a seal between the first and second brackets as the first seal is compressed between the first and second brackets.

12. The apparatus of claim 11, further comprising:

a pressing plate coupled to an interior facing side of the first bracket, wherein the pressing plate is configured to guide power connectors of the heater through the pressing plate and an opening in the first bracket so as to secure the heater in the heater receiving opening formed in the tub;

a fastener that fastens the pressing plate to the first bracket; and a second seal positioned between the pressing plate and the first bracket, wherein the second seal forms a seal between pressing plate and the first bracket and prevents leakage of washing fluid as the second seal is compressed between the pressing plate and the first bracket by the fastener.

* * * * *